US005797763A

United States Patent [19]

Saka et al.

[11] Patent Number: 5,797,763

[45] Date of Patent: Aug. 25, 1998

[54] ELECTRICAL CONNECTION BOX

[75] Inventors: Yuuji Saka; Nori Inoue; Takahiro Onizuka; Yoshito Oka; Makoto Kobayashi, all of Yokkaichi, Japan

[73] Assignee: Sumitomo Wiring Systems, Ltd., Yokkaichi, Japan

[21] Appl. No.: 547,468

[22] Filed: Oct. 24, 1995

[30] Foreign Application Priority Data

| | | | |
|---|---|---|---|
| Nov. 29, 1994 | [JP] | Japan | 6-294788 |
| Dec. 26, 1994 | [JP] | Japan | 6-322611 |

[51] Int. Cl.[6] ..... H01R 4/24

[52] U.S. Cl. ..... 439/402; 439/485; 439/949

[58] Field of Search ..... 439/76.2, 402–405, 439/949, 485

[56] References Cited

U.S. PATENT DOCUMENTS

| | | | |
|---|---|---|---|
| 4,227,763 | 10/1980 | Marks | 439/392 |
| 4,494,814 | 1/1985 | Oyama | 439/485 |
| 4,684,765 | 8/1987 | Beck et al. | 439/76 |
| 4,897,042 | 1/1990 | Saka et al. | 439/404 |
| 4,938,719 | 7/1990 | Sawai et al. | 439/404 |
| 5,055,064 | 10/1991 | Imaizumi et al. | 439/402 |
| 5,207,587 | 5/1993 | Hamill et al. | 439/76 |
| 5,269,700 | 12/1993 | Mitra | 439/402 |
| 5,326,275 | 7/1994 | Murakami | 439/189 |
| 5,412,861 | 5/1995 | Fudoo et al. | 29/564.2 |
| 5,501,605 | 3/1996 | Ozaki et al. | 439/34 |
| 5,653,607 | 8/1997 | Saka et al. | 439/402 |

FOREIGN PATENT DOCUMENTS

| | | |
|---|---|---|
| 0043437 | 1/1982 | European Pat. Off. . |
| 0044636 | 1/1982 | European Pat. Off. . |
| 0703117 | 3/1996 | European Pat. Off. . |
| 1941050 | 3/1971 | Germany . |
| 8714703 | 4/1989 | Germany . |
| 4419895 | 1/1995 | Germany . |
| 60-35911 | 2/1985 | Japan . |
| 391015 | 9/1991 | Japan . |
| 3-120627 | 12/1991 | Japan . |
| 6-197432 | 7/1994 | Japan . |
| 2264885 | 9/1993 | United Kingdom . |

*Primary Examiner*—Neil Abrams
*Attorney, Agent, or Firm*—Greenblum & Bernstein P.L.C.

[57] ABSTRACT

An electrical connection box includes an internal circuit in which a several pressing contact terminals are brought into pressing contact with a wire. Input-output terminals of the pressing contact terminals are connected to external circuits. The wire includes an electrically operative portion between one of the pressing contact terminals connected to an external electrical heating element (such as a relay, a fuse, or the like) and another one of the pressing contact terminals. In one example (FIGS. 5 and 6), the electrically operative portion is shifted from a minimal distance path, which takes into account other wires and obstacles, between the one pressing contact terminal and the another pressing contact terminal. This lengthens the wiring path of the wire to a region having a low wiring density which provides additional surface area for heat dissipation. In another examples, (FIGS. 7 and 8) inoperative ends (b, c) of the wire are extend and used to dissipate heat. An inoperative separate wire (W6) can also dissipate heat (FIG. 6). A large contact area (FIGS. 10–18) can dissipate heat and may be formed with splice wires (FIG. 11) and/or a large opening for loosely receiving a wire (FIG. 18).

4 Claims, 10 Drawing Sheets

ELECTRICAL CONNECTION BOX

BACKGROUND OF THE INVENTION

The present invention generally relates to electrical connection boxes in which an internal circuit is constituted by a wire and pressing contact terminals brought into pressing contact with the wire and more particularly, to an electrical connection box in which heat dissipation of a wire connected to external electrical heating elements such as a relay and a fuse is facilitated such that quantity of electric current flowing through the wire is increased.

Conventionally, in order to easily cope with changes of design of an internal circuit of an electrical connection box in which electric circuits including a number of fuses, relays, etc. are arranged in a concentrated manner such that branch connection of wiring harnesses is performed reasonably, such an arrangement has been provided in which a wire is laid in the electrical connection box and is connected to external input-output terminals by pressing contact terminals in place of bus bars formed by blanking electrically conductive plates.

For example, in a known electrical connection box shown in FIG. 1, a wire W is laid on an insulating plate 3 disposed in a casing of the electrical connection box, which is constituted by an upper casing 1 and a lower casing 2 and pressing contact terminals 5 and 6 are brought into pressing contact with the wire W. A tab 5*a* of the pressing contact terminal 5, which acts as an input-output terminal portion, is projected out of a terminal hole formed on a bottom wall of a fuse receiver 1*a* protruding from an upper face of the upper casing 1 and is connected, as shown in FIG. 2, to a terminal 8 of a fuse 7, which is fitted into a bore of the fuse receiver 1*a*. In addition to the fuse receiver 1*a*, a relay receiver and a connector receiver are provided on the upper face of the upper casing 1 and tabs 6*a* of tabs 6 brought into pressing contact with the wire W are projected into the relay receiver and the connector receiver so as to be connected to relays and contact bonding terminals connected to electric devices.

In case components connected to the wire W of the internal circuit through the pressing contact terminals are electrical heating elements such as the fuse 7 and the relay as described above, heat is transferred to the tabs 5*a* and 6*a* of the pressing contact terminals 5 and 6, which are brought into contact with the terminal 8, etc. and is further transferred from the pressing contact terminals 5 and 6 to the wire W, so that the wire W undergoes thermal influence. Usually, an electrically operative portion a of the wire W, which is interposed between the pressing contact terminals 5 and 6 at input and output sides, respectively, is set to a shortest distance, while an electrically inoperative portion b of the wire W other than the electrically operative portion a is cut off in the vicinity of spots of connection between the wire W and the pressing contact terminals 5 and 6 such that the wire W is shortened.

If the wire W is shortened as described above, heat dissipation from the wire W is small, so that temperature of the electrically operative portion a rises readily and thus, quantity of electric current capable of flowing through the wire W is lessened. As a result, such a problem arises that circuit configuration becomes complicated due to, for example, the need for division of the internal circuit. Furthermore, if the wire W is heated by the electrical heating elements connected to the wire W, such an inconvenience is incurred that temperature of whole interior of the electrical connection box also rises.

Meanwhile, in case an internal circuit of an electrical connection box is constituted by conventional bus bars, heat dissipation is performed by the bus bars each having a large area. However, in case the internal circuit of the electrical connection box is constituted by a wire and pressing contact terminals, heat dissipation area of a known pressing contact terminal T is small as shown in FIG. 3. Therefore, if heat is produced by contact resistance at a pressing contact portion of the known pressing contact terminal T, which is brought into pressing contact with the wire W, heat is accumulated in the known pressing contact terminal T so as to set the known pressing contact terminal T to high-temperature state. As a result, such a drawback may be encountered that since creep is produced at a blade B disposed at an inner periphery of a slot portion S of the known pressing contact terminal T, performance of the known pressing contact terminal T is apt to deteriorate. Furthermore, in the case of a wire used for a large-current circuit such as a power circuit connected to fuses or relays and a through-circuit, heat produced by the fuses or relays is transferred to the wire and thus, temperature of the wire readily rises undesirably.

Moreover, regardless of whether a large-current circuit or a small-current circuit, an internal circuit of an electrical connection box requires a circuit including splice portions. However, a conventional pressing contact terminal may be provided with a plurality of input-output terminal portions but usually has only one slot portion for its pressing contact with a wire. Therefore, the conventional pressing contact terminal has not been used for splice of a plurality of wires. Even if two slot portions or more are formed on the conventional pressing contact terminal and the conventional pressing contact terminal is brought into pressing contact with a plurality of the wires so as to be spliced to the wires, heat produced at a plurality of pressing contact portions of the conventional pressing contact terminal cannot be dissipated satisfactorily due to its small heat dissipation area.

Meanwhile, a pressing contact terminal in which two slot portions parallel to each other along a wire extend downwardly from a lower portion of an input-output terminal portion so as to be spaced an interval from each other is known. However, in this prior art pressing contact terminal, the slot portions are merely brought into pressing contact with the identical wire at the interval such that pressing contact of the known pressing contact terminal with the wire is secured. Therefore, no pressing contact terminal adapted for splice of two wires or more is known.

Accordingly, conventionally, a plurality of wires cannot be directly spliced to each other by a pressing contact terminal. Thus, in the case where the number of splice portions increases due to, e.g., minor changes in design of a motor vehicle of an identical type, many pressing contact terminals should be press fitted into the wires so as to effect branching of a circuit, so that both the number of the wires and that of the pressing contact terminals are required to be increased.

SUMMARY OF THE INVENTION

Accordingly, a first object of the present invention is to provide, with a view to eliminating the above mentioned drawbacks of conventional electrical connection boxes, an electrical connection box in which by facilitating heat dissipation of a wire connected, via pressing contact terminals, to external electrical heating elements such as a relay and a fuse, not only a large quantity of electric current can flow through the wire but rise of temperature of interior of the electrical connection box is restrained.

A second object of the present invention is to provide an electrical connection box in which heat dissipation of the pressing contact terminal can be performed effectively, a plurality of wires can be spliced to each other by the pressing contact terminal and the pressing contact terminal can be brought into pressing contact with even wires having splice portions in various states.

In order to accomplish the first object of the present invention, an electrical connection box according to the present invention includes an internal circuit in which a plurality of pressing contact terminals are brought into pressing contact with a wire and input-output terminal portions of the pressing contact terminals are connected to external circuits, respectively; wherein the wire includes an electrically operative portion between one of the pressing contact terminals connected to an external electrical heating element such as a relay, a fuse or the like and another one of the pressing contact terminals; the improvement comprising: the electrically operative portion being shifted from a course connecting the one of the pressing contact terminals and the another one of the pressing contact terminals at a minimum distance to a region having low wiring density so as to be lengthened in a wiring path of the wire.

In the electrical connection box, since the electrically operative portion of the wire is shifted from the hitherto taken course connecting the pressing contact terminals at the minimum distance to the region having low wiring density so as to be lengthened, quantity of heat dissipated from the wire can be increased. Furthermore, since the region to which the electrically operative portion is shifted has low wiring density and is least likely to undergo thermal influence from other wires, rise of temperature of the wire can be restrained effectively and thus, quantity of electric current flowing through the wire can be increased.

Meanwhile, in order to accomplish the second object of the present invention, an electrical connection box according to the present invention includes an internal circuit in which a pressing contact terminal is brought into pressing contact with a wire; the improvement comprising: the pressing contact terminal being formed by an electrical conductive plate and including a wide rectangular flat plate portion for heat dissipation such that at least one downwardly opening slot for pressing contact with the wire is formed at a lower end of the flat plate portion.

In the electrical connection box, since the pressing contact terminal includes the wide rectangular flat plate portion for heat dissipation, heat from the wire connected to the slot through pressing contact can be dissipated efficiently by the flat plate portion, so that it is possible to prevent the pressing contact terminal and the wire from being heated to high temperature.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
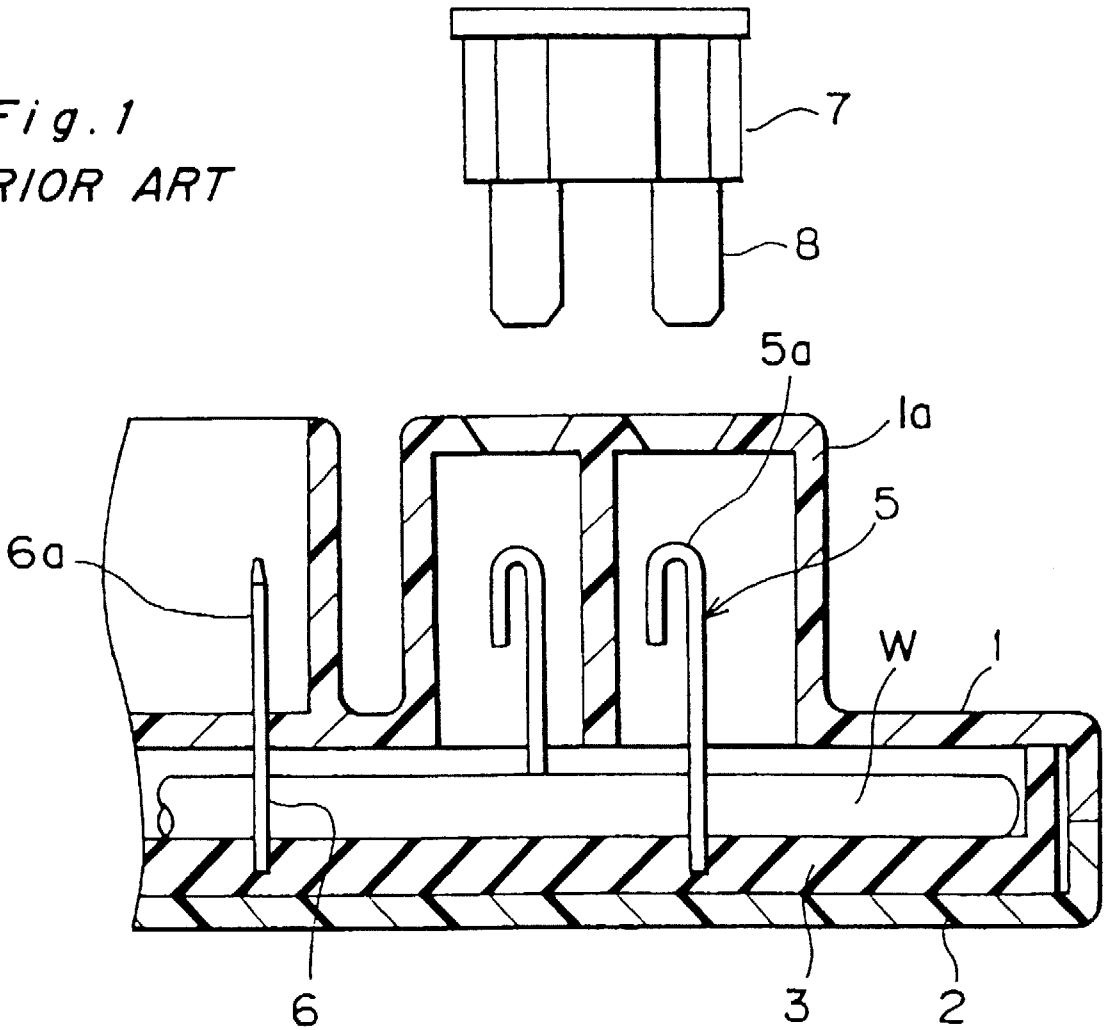
Fig. 1 PRIOR ART
FIG. 1 is a fragmentary sectional view of a prior art electrical connection box (already referred to)
Figure 4:
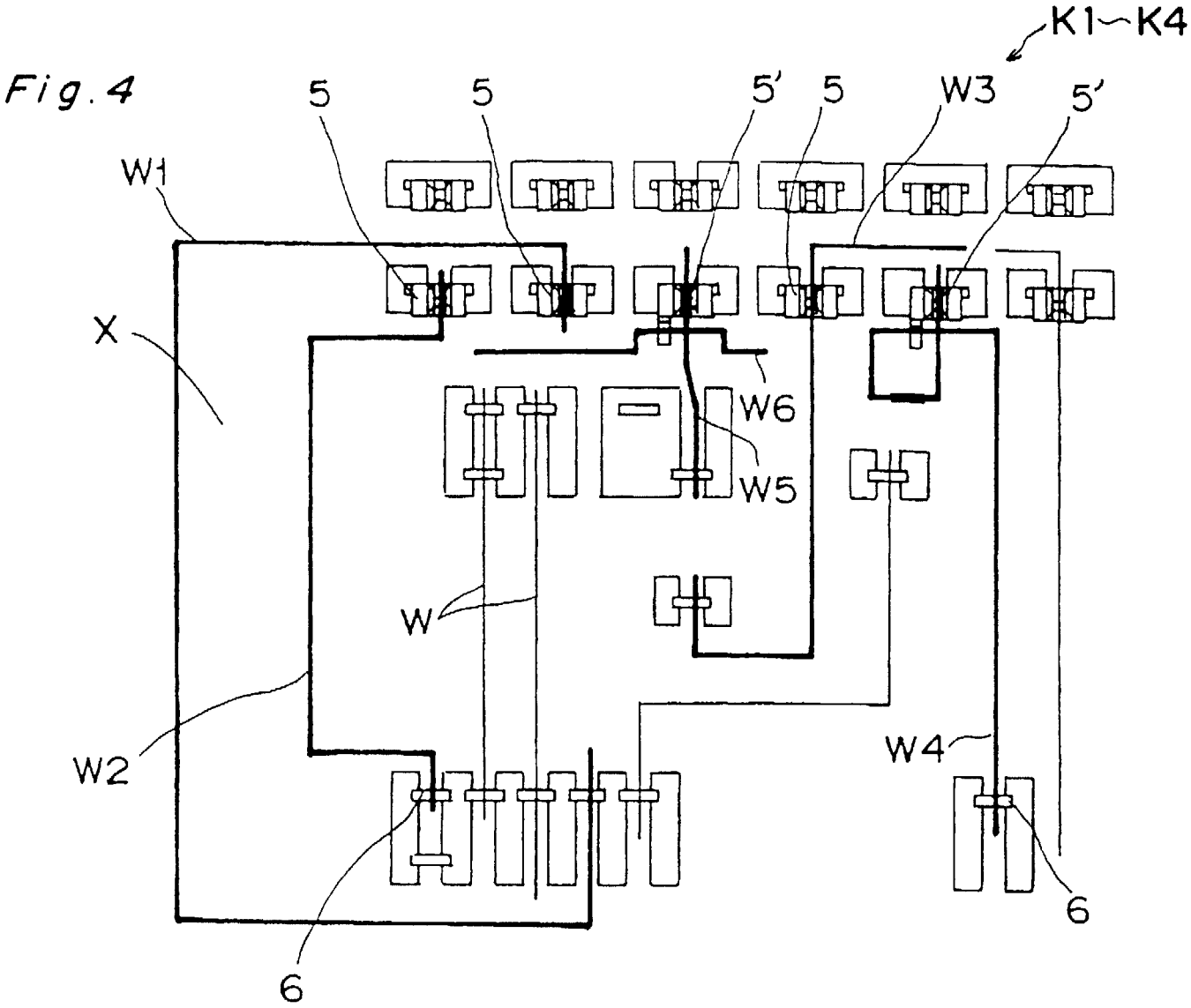
FIG. 4 is a schematic view showing whole configuration of an internal circuit of electrical connection boxes according to first to fourth embodiments of the present invention.

FIG. 4 shows an internal circuit of electrical connection boxes K1 to K4 according to first to fourth embodiments of the present invention. In the electrical connection boxes K1 to K4 shown in FIGS. 5 to 9, a wire is laid in the same manner as prior art of FIG. 1. Therefore, laying of the wire in the electrical connection boxes K1 to K4 is described with reference to FIG. 1, hereinafter. Pressing contact terminals 5 and 6 are connected, through pressing contact, to a wire W laid preliminarily on an insulating plate 3 so as to form the internal circuit. Then, the insulating plate 3 preliminarily assembled with the wire W and the pressing contact terminals 5 and 6 is accommodated in an upper casing 1 and a lower casing 2 such that the electrical connection boxes K1 to K4 are assembled. At this time, tabs 5*a* and 6*a* FIG. 5 of the pressing contact terminals 5 and 6, which act as input-output terminal portions of the pressing contact terminals 5 and 6, respectively, are projected into a relay receiver 1*a*, a fuse receiver and a connector receiver which protrude from an upper face of the upper casing 1 so as to be connected not only to external electrical heating elements such as a relay and a fuse but to a connector fitted into the connector receiver and leading to a load circuit.

As shown in FIGS. 1, 2 and 5 to 9, the tab 6*a* of the pressing contact terminal 6, which acts as the input-output terminal portion of the pressing contact terminal 6, is formed into a flat platelike shape and is to be inserted into a terminal receiving slit of a connector so as to be connected to a contact bonding terminal contact bonded to a distal end of a wire. Thus, the pressing contact terminal 6 mainly functions as a pressing contact terminal at an output side. On the other hand, the tab 5*a* of the pressing contact terminal 5 is folded down into a U-shaped form and a terminal receiving groove 5*c* extends from an upper end of the tab 5*a* downwardly and a terminal 8 of a fuse 7 or a terminal of a relay (not shown) is inserted into the terminal receiving groove 5*c* so as to be connected to the pressing contact terminal. Hence, the pressing contact terminal 5 mainly functions as a pressing contact terminal at an input side.

In the electrical connection boxes K1 to K4 in which the internal circuit is constituted by the wire W and the pressing contact terminals 5 and 6 brought into pressing contact with the wire W as described above, heat dissipation of wires W1 to W5 each of which is connected to the fuse 7 through the pressing contact terminal 5 at the input side and the connector of the load circuit via the pressing contact terminal 6 at the output side as shown in FIG. 4 is facilitated.

Figure 5:
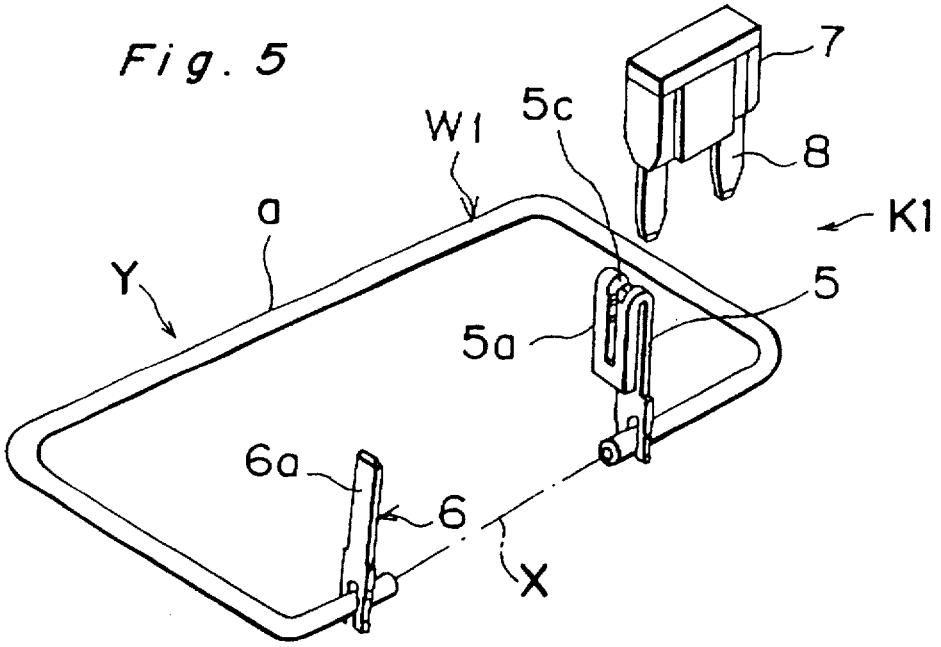
FIG. 5 is a perspective view showing connection between a pressing contact terminal and a fuse in the electrical connection box according to the first embodiment of the present invention in FIG. 4.

Initially, in the wire W1 of the electrical connection box K1 of the first embodiment shown in FIG. 5, the pressing contact terminal 5 connected to the terminal 8 of the fuse 7 and the pressing contact terminal 6 connected to the connector of the load circuit are disposed adjacent to each other so as to confront each other and an electrically operative portion a of the wire W1, which is connected to the pressing contact terminals 5 and 6, is intentionally shifted from a course X of the one-dot chain line connecting the pressing contact terminals 5 and 6 at a minimum distance to a region Y having low wiring density such that length of the electrically operative portion a is increased. Conventionally, as shown in FIG. 2, the electrically operative portion a between the pressing contact terminals 5 and 6 extends along the course X of FIG. 5 so as to assume the minimum distance.

Figure 2:
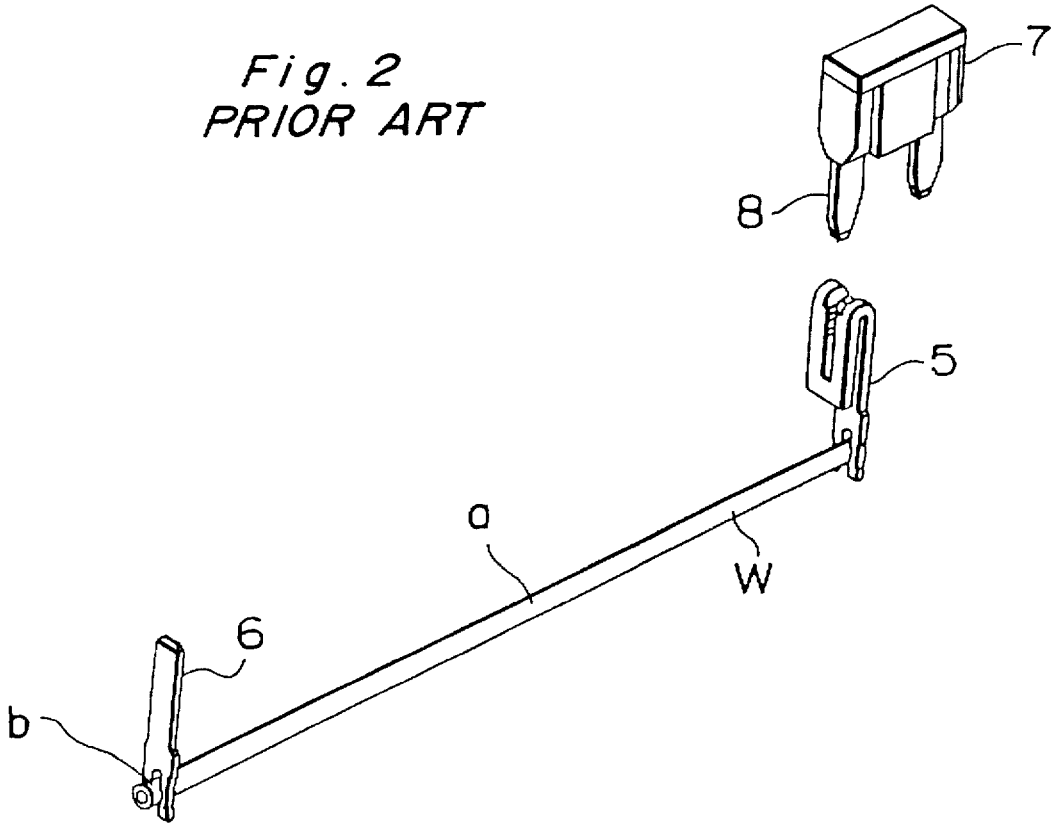
Fig. 2 PRIOR ART
FIG. 2 is a perspective view showing connection between a pressing contact terminal and a fuse in the prior art electrical connection box of FIG. 1 (already referred to)

If the electrically operative portion a of the wire W1 is intentionally shifted from the course X connecting the pressing contact terminals 5 and 6 at the minimum distance so as to be lengthened as described above, length of the electrically operative portion a in FIG. 5 is more than about six times that of a case in which the electrically operative portion a extends along the course X of the one-dot chain line as in prior art of FIG. 2. In the electrical connection box K1, since length of the electrically operative portion a of the wire W1 is increased, quantity of heat dissipation from the wire W1 can be increased and thus, heating of the wire W1 can be restrained accordingly. As a result, quantity of electric current flowing through the wire W1 can be increased. Therefore, even in the case where the internal circuit has been conventionally required to be divided into a plurality of circuit sections in view of quantity of electric current flowing through the wire, the internal circuit can be formed by a single circuit in the electrical connection box K1.

Figure 6:
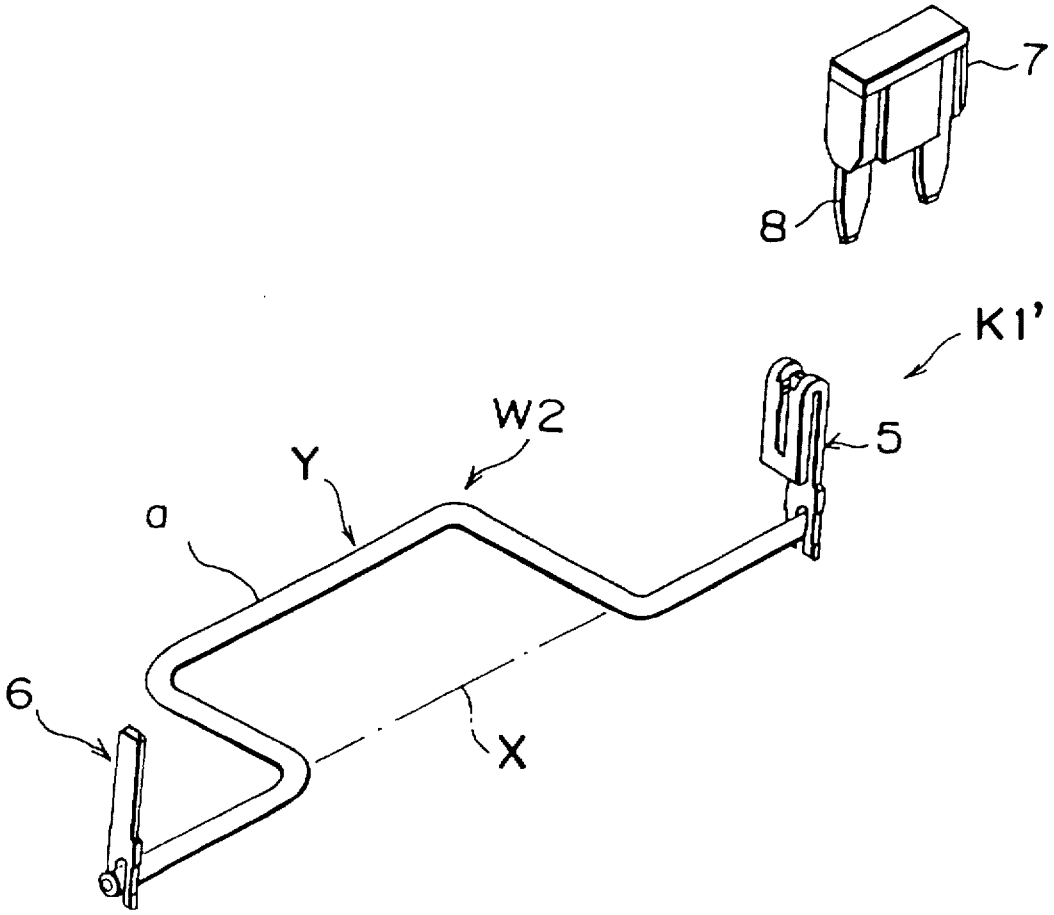
FIG. 6 is a view to similar to FIG. 5, particularly showing its modification.

FIG. 6 shows an electrical connection box K1' which is a modification of the electrical connection box K1. In the electrical connection box K1', the electrical operative portion a of the wire W2, which is disposed between the pressing contact terminal 5 connected to the terminal 8 of the fuse 7 and the pressing contact terminal 6 connected to the connector of the load circuit, is partially shifted intentionally from the course X of the one-dot chain line connecting the pressing contact terminals 5 and 6 at a minimum distance to the region Y of low wiring density. In the electrical connection box K1', length of the electrically operative portion a of the wire W2 is increased to about twice that of a case in which the electrically operative portion a extends along the course X of the one-dot chain line as in prior art of FIG. 2.

Figure 7:
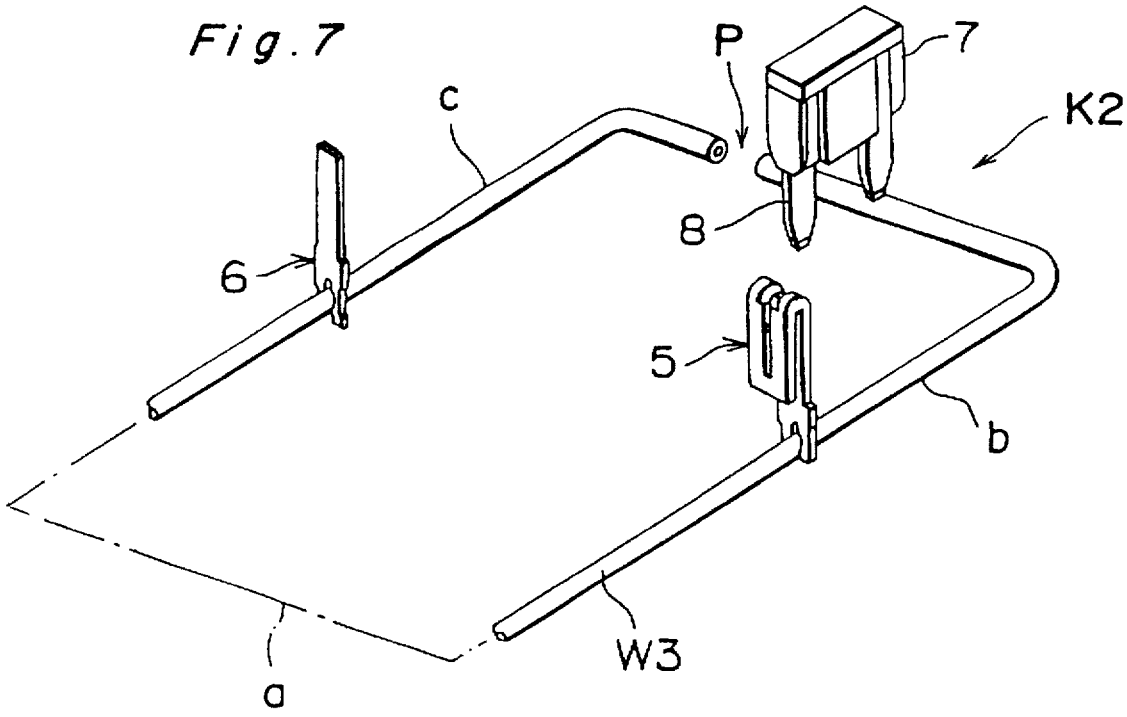
FIGS. 7, 8 and 9 are perspective views showing connection between a pressing contact terminal and a fuse in the electrical connection boxes according to the second, third and fourth embodiments of the present invention in FIG. 4, respectively.

In the wire W3 of the electrical connection box K2 of the second embodiment shown in FIG. 7, if the electrically operative portion a which is disposed between the pressing contact terminal 5 connected to the terminal 8 of the fuse 7 and the pressing contact terminal 6 connected to the connector of the load circuit cannot be intentionally lengthened for some reason or other associated with configuration of the internal circuit, other portions of the wire W3 than the electrically operative portion a interposed between the pressing contact terminals 5 and 6, i.e., electrically inoperative portions b and c disposed adjacent to the pressing contact terminals 5 and 6, respectively are intentionally extended so as to be lengthened.

The electrically operative portion a and the electrically inoperative portions b and c of the wire W3 are laid continuously at the time of wiring. Conventionally, the electrically inoperative portions b and c other than the electrically operative portion a are cut off from the wire W3 in the vicinity of the pressing contact terminals 5 and 6 so as to be removed from the wire W3.

On the other hand, in the electrical connection box K2, the electrically inoperative portions b and c are not removed from the wire W3 but instead, a portion P of the electrically inoperative portions b and c is severed so as to prevent electric current from flowing through the electrical inoperative portions b and c. Thus, the electrically inoperative portions b and c extending over a long distance are provided so as to act as a heat dissipation area of the wire W3.

Electric current does not flow through the electrically inoperative portions b and c but heat from the electrically operative portion a is transferred to the electrically inoperative portions b and c such that heat dissipation is facilitated from the long electrically inoperative portions b and c.

Figure 8:
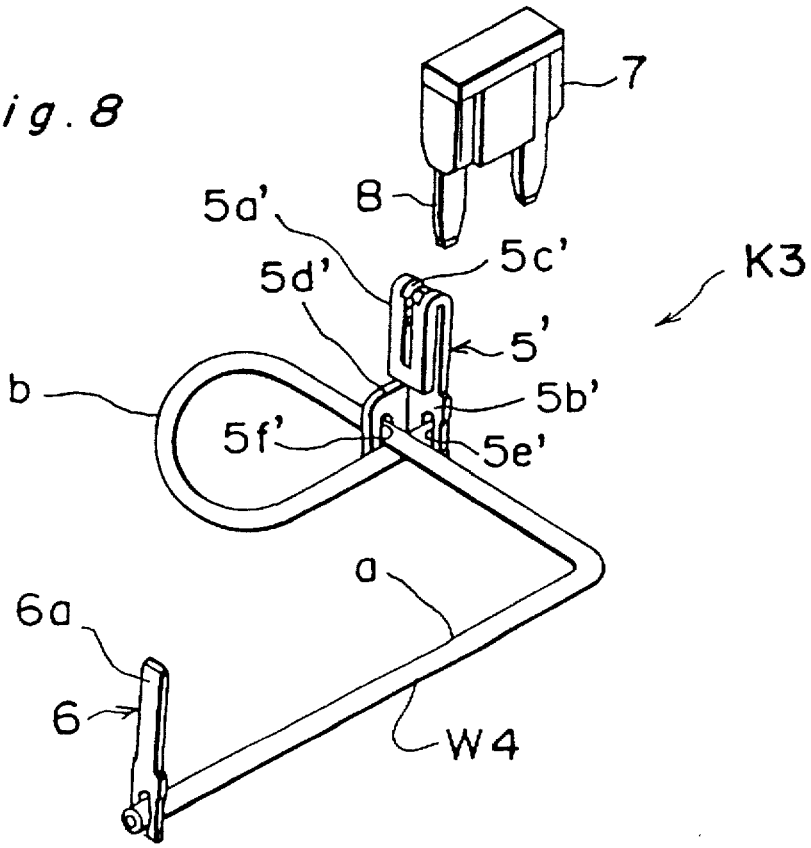

In the wire W4 of the electrical connection box K3 of the third embodiment shown in FIG. 8, a pressing contact terminal 5' which is connected to the terminal 8 of the fuse 7 has two pressing contact portions, i.e., first and second pressing contact portions 5*b'* and 5*d'*. One of the first and second pressing contact portion 5*b'* and 5*d'* is brought into pressing contact with the electrically operative portion a, while the other of the first and second pressing contact portion 5*b'* and 5*d'* is brought into pressing contact with the electrically inoperative portion b.

Namely, the first pressing contact portion 5*b'* extends continuously from a lower portion of a tab 5*a'* of the pressing contact terminal 5' and the second pressing contact portion 5*d'* is bent orthogonally from the first pressing contact portion 5*b'* . Slots 5*e'* and 5*f'* are, respectively, formed at the first and second pressing contact portions 5*b'* and 5*d'* and a pressing contact blade is, in turn, formed at a periphery edge of each of the slots 5*e'* and 5*f'*.

After the electrically operative portion a of the wire W4 has been connected to the second pressing contact portion 5*d'* through pressing contact, the electrically inoperative portion b is extended from the electrically operative portion a. As shown in FIG. 8, the electrically inoperative portion b is curved arcuately and a distal end of the electrically inoperative portion b is brought into pressing contact with the first pressing contact portion 5*b'*.

By providing the electrically inoperative portion b extending over a long distance, heat dissipation can be facilitated from this long electrically inoperative portion b. In addition, since heat from the terminal 8 of the fuse 7 is transferred to both the electrically operative portion a and the electrically inoperative portion b, quantity of heat transferred from the fuse 7 to the electrically operative portion a can be reduced accordingly. By this double heat dissipation effect, thermal influence exerted upon the electrically operative portion a can lessened.

Furthermore, since the electrically operative portion b can be laid orthogonally to the second pressing contact portion 5*d'* for the electrically operative portion a, the electrically operative portion b can be provided without interfering with the electrically operative portion a.

Figure 9:
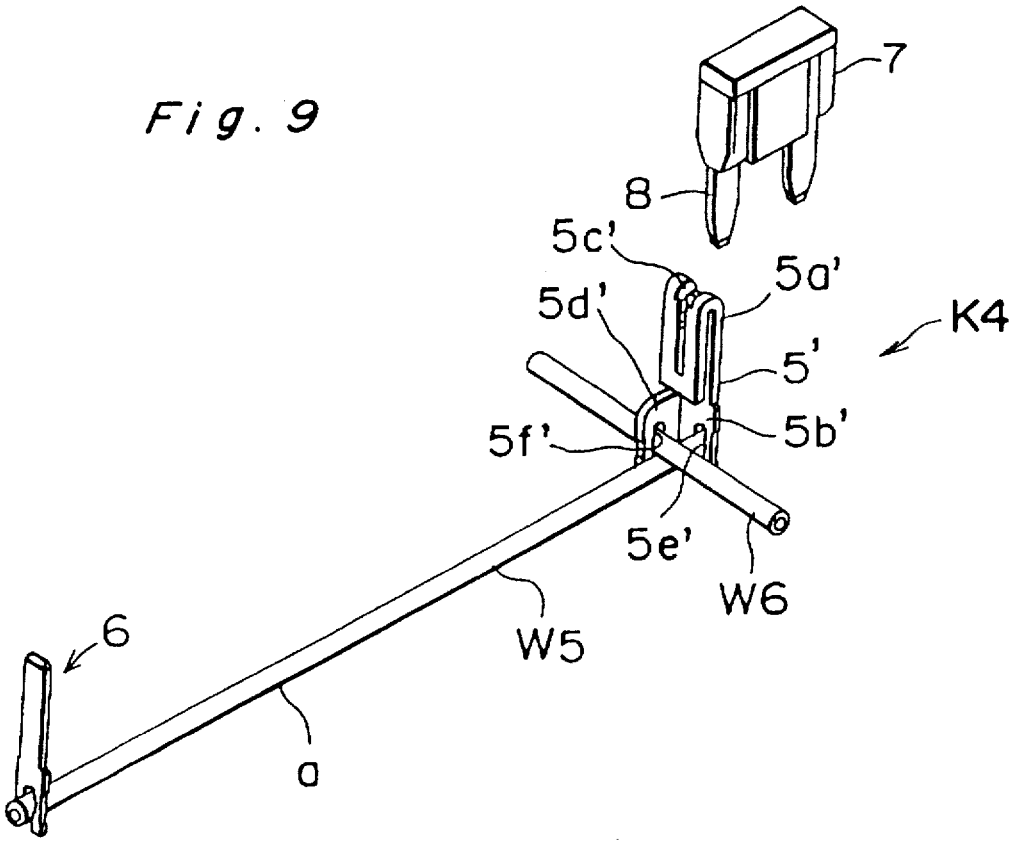

Meanwhile, in the wire W5 of the electrical connection box K4 of the fourth embodiment shown in FIG. 9, the pressing contact terminal 5' of the third embodiment is employed but a further wire W6 is used for heat dissipation in addition to the wire W5 acting as a wire for the internal circuit. Namely, the electrically operative portion a of the wire W5 is brought into pressing contact with the first pressing contact portion 5*b'* of the pressing contact terminal 5', while the wire W6 for only heat dissipation is brought into pressing contact with the second pressing contact portion 6*d'*. In the electrical connection box K4, since heat from the terminal 8 of the fuse 7 is transferred to not only the wire W5 but the wire W6, quantity of heat transferred to the wire W5 for the internal circuit can be reduced.

As is clear from the foregoing description of the first embodiment, since the electrically operative portion of the wire is intentionally shifted from the course connecting the neighboring pressing contact terminals at the minimum distance to the region of low wiring density so as to be lengthened, quantity of heat dissipated from the wire can be increased by amount of increase of length of the wire. Therefore, quantity of electric current flowing through the wire can be increased and rise of temperature of interior of the electrical connection box can be restrained. Since the electrically operative portion of the wire is merely shifted to the region of low wiring density, an existing construction can be utilized as it is advantageously.

Meanwhile, in the second embodiment (FIG. 7), the electrically inoperative portion which has been removed from the wire conventionally is merely utilized without being removed from the wire and a portion of the electrically inoperative portion is severed so as to prevent electric current from flowing through the electrically inoperative portion. Therefore, heat dissipation of the electrically operative portion of the wire can be facilitated more easily.

Furthermore, in the third and fourth embodiments (FIGS. 8 and 9), since the pressing contact terminal connected to the electrical heating element is improved in shape so as to be brought into pressing contact with the electrically inoperative portion of the wire or the wire for only heat dissipation, heat transferred from the electrical heating element to the pressing contact terminal can be dividedly transferred to the electrically operative portion of the wire for the internal circuit and the electrically inoperative portion of the wire or the wire for only heat dissipation and thus, quantity of heat transferred to the electrically operative portion can be reduced.

Figure 10:
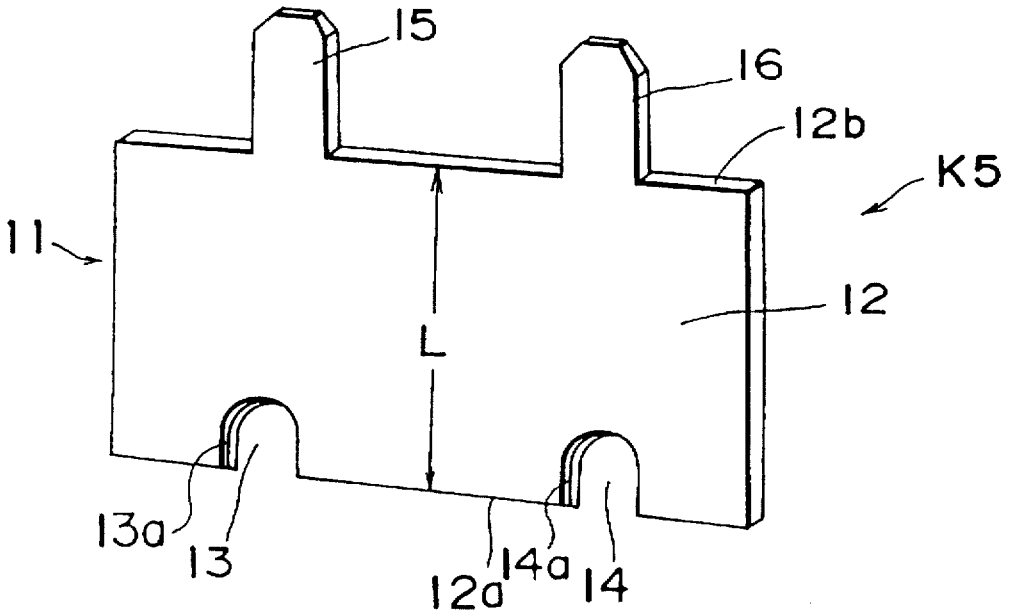
FIG. 10 is a perspective view of a pressing contact terminal employed in an electrical connection box according to a fifth embodiment of the present invention.
Figure 11:
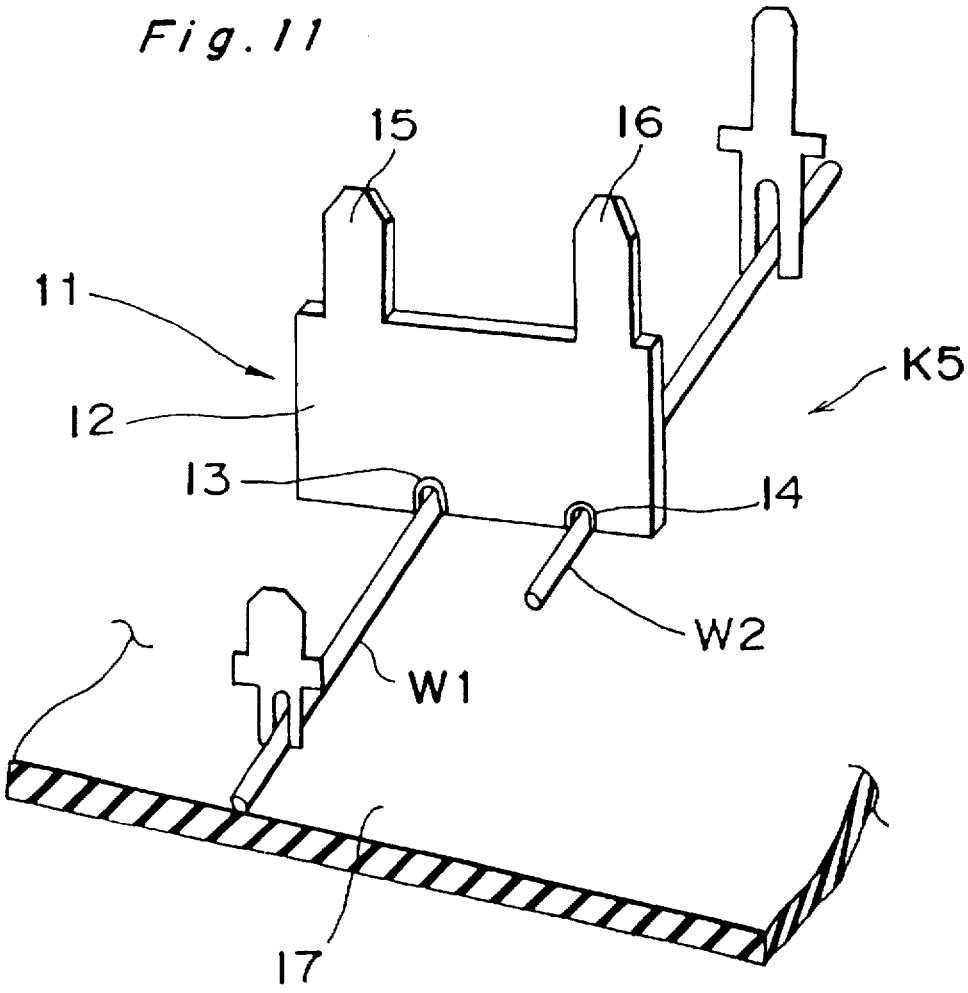
FIG. 11 is a perspective view showing connection between the pressing contact terminal of FIG. 10 and wires.

Moreover, FIG. 10 shows a pressing contact terminal 11 employed in an electrical connection box K5 according a fifth embodiment of the present invention. FIG. 11 shows a state in which wires W1 and W2 are spliced to each other by the pressing contact terminal 11. The pressing contact terminal 11 is formed by blanking a thin and flat electrically conductive plate having excellent dissipation property. Namely, by blanking an electrically conductive plate, a rectangular flat plate portion 12 for heat dissipation, which has a large width L, is obtained and downwardly opening slots 13 and 14 are formed on a lower end 12*a* of the flat plate portion 12 so as to be spaced a predetermined interval from each other along the lower end 12*a* of the flat plate portion 12. Pressing contact blades 13*a* and 14*a* are, respectively, formed on peripheries of the slots 13 and 14 so as to each have an acute angle. Input-output terminal portions 15 and 16 each having a shape of a tab are projected from an upper end 12*b* of the flat plate portion 12.

Figure 3:
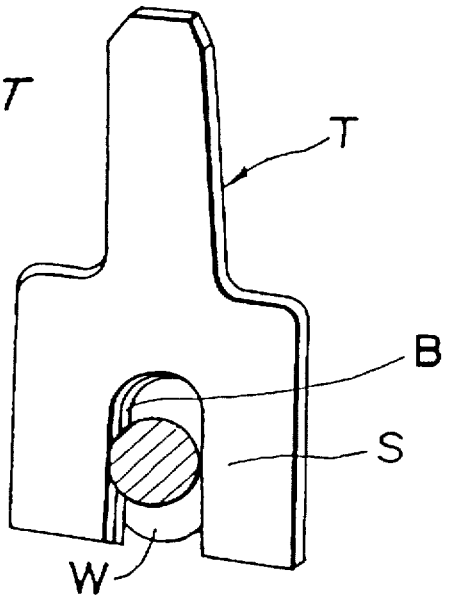
Fig. 3 PRIOR ART
FIG. 3 is a perspective view of a prior art pressing contact terminal (already referred to)

A whole surface area of the flat plate portion 12 is set at not less than 1.3 times that of a prior art pressing contact terminal T shown in FIG. 3. Therefore, heat dissipation property of the pressing contact terminal 11 is set so as to be not less than 1.3 times as excellent as that of the prior art pressing contact terminal T. When the flat plate portion 12 is set vertically as shown in FIG. 11, the pressing contact terminal 11 is driven into the wires W1 and W2 so as to bring the slots 13 and 14 into pressing contact with the wires W1 and W2, respectively such that the pressing contact blades 13*a* and 14*a* are, respectively, connected to conductors of the wires W1 and W2 through pressing contact. A wire is continuously laid on an insulating plate 17 disposed in the electrical connection box K5 but is severed into the wires W1 and W2 in accordance with configuration of the internal circuit. Meanwhile, the pressing contact terminal 11 may also be brought into pressing contact with a wire laid in a wiring groove formed in an insulating plate provided in the electrical connection box K5.

The pressing contact terminal 11 held in pressing contact with the wires W1 and W2 splices the wires W1 and W2 to each other. Furthermore, the input-output terminal portions 15 and 16 projecting from the upper end 12*b* of the flat plate portion 12 extend through terminal holes of a casing of the electrical connection box K5 so as to be connected to external terminals (not shown), respectively. Therefore, the pressing contact terminal 11 not only splices the wires W1 and W2 to each other but is connected to the external terminals. Accordingly, circuits of the wires W1 and W2 branch off from each other through the input-output terminal portions 15 and 16 so as to be connected to external circuits, respectively.

Meanwhile, since the pressing contact terminal 11 has the two pressing contact portions 13 and 14, heat is generated at the pressing contact portions 13 and 14. However, since the flat plate portion 12 for heat dissipation has large surface area, heat generated at the pressing contact portions 13 and 14 can be dissipated efficiently and thus, is not accumulated in the pressing contact terminal 11 or the wires W1 and W2.

Figure 12:
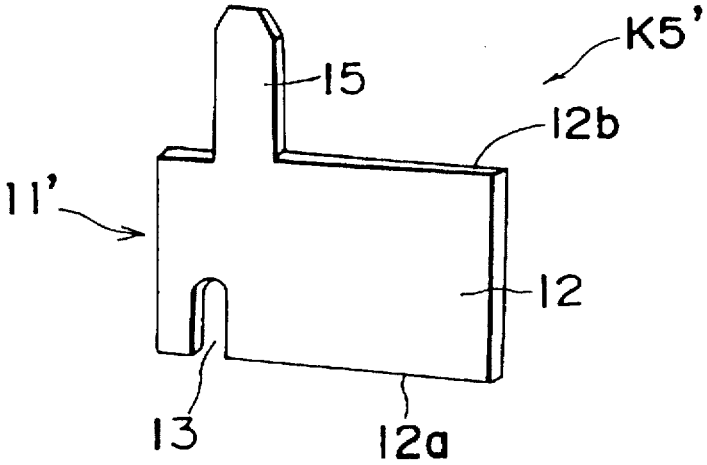
FIGS. 12 and 13 are perspective views showing pressing contact terminals which are first and second modifications of the pressing contact terminal of FIG. 10, respectively.
Figure 13:
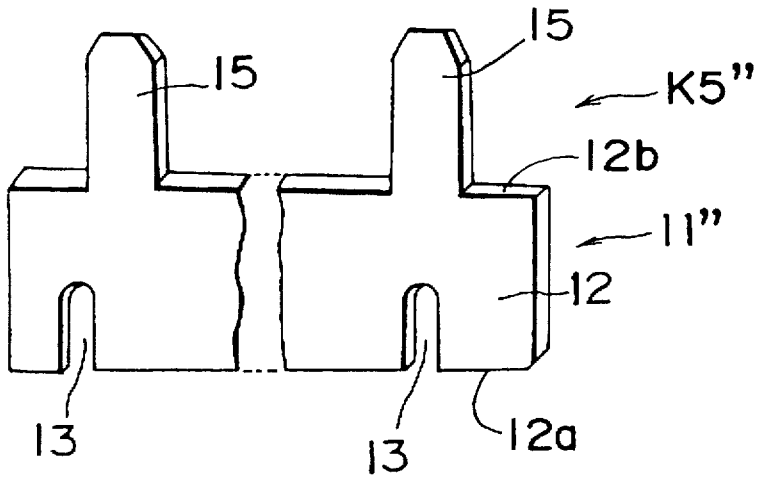

FIGS. 12 and 13 show pressing contact terminals 11' and 11" employed in electrical connection boxes K5' and K5" which are first and second modifications of the electrical connection box K5, (boxes K5' and K5" not being shown) respectively. In the pressing contact terminal 11', the single slot 13 is provided at the lower end 12*a* of the flat plate portion 12, while the single input-output terminal portion 15 is projected from the upper end 12*b* of the flat plate portion 12. On the other hand, in the pressing contact terminal 11", a number of the slots 13 are provided at the lower end 12*a* of the flat plate portion 12, while a number of the input-output terminal portions 15 are projected from the upper end 12*b* of the flat plate portion 12.

Figure 14:
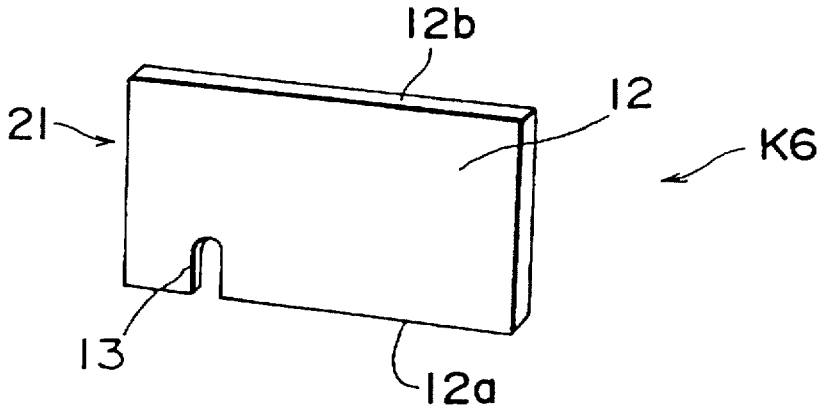
Fig. 14 is a perspective view of a pressing contact terminal employed in an electrical connection box according to a sixth embodiment of the present invention.

FIG. 14 shows a pressing contact terminal 21 employed in an electrical connection box K6 according to a sixth embodiment of the present invention. In the pressing contact terminal 21, the single slot 13 is provided at the lower end 12*a* of the flat plate portion 12, while no input-output terminal portion is provided at the upper end 12*b* of the flat plate portion 12. Therefore, the pressing contact terminal 21 functions to dissipate heat of a wire brought into pressing contact with the slot 13.

Figure 15:
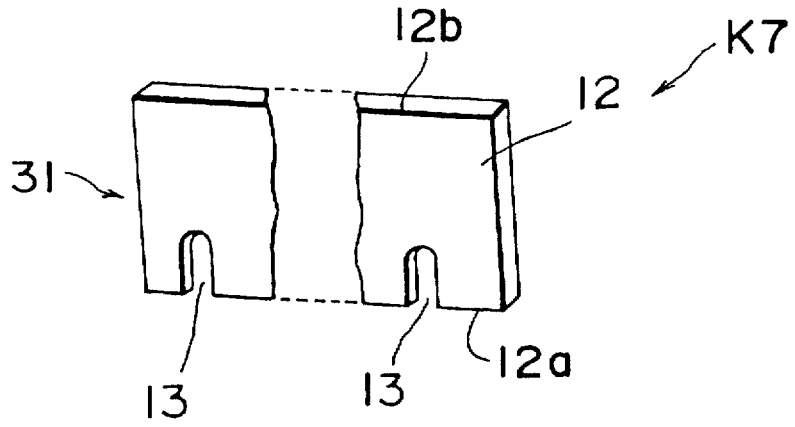
FIG. 15 is a perspective view of a pressing contact terminal employed in an electrical connection box according to a seventh embodiment of the present invention.

FIG. 15 shows a pressing contact terminal 31 employed in an electrical connection box K7 according to a seventh embodiment of the present invention. In the pressing contact terminal 31, the not less than two slots 13 are formed at the lower end 12*a* of the flat plate portion 12, while no input-output terminal portion is provided at the upper end 12*b* of the flat plate portion 12. The pressing contact terminal 31 functions to not only splices a plurality of wires to each other but facilitate heat dissipation of the wires and the slots 13.

Figure 16:
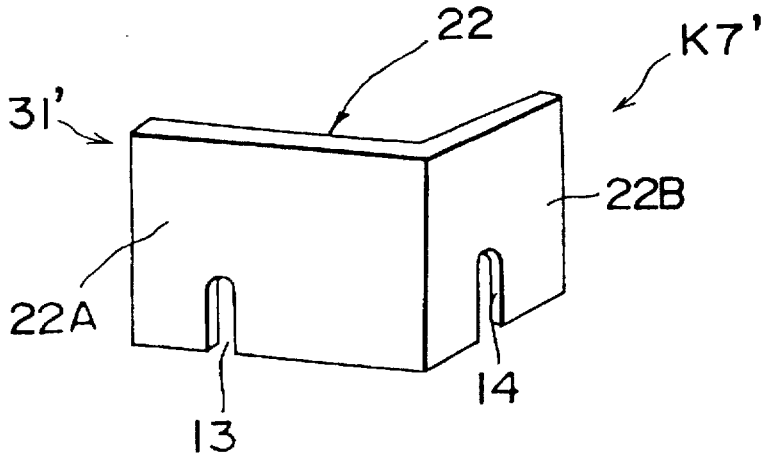
FIGS. 16 and 17 are perspective views showing pressing contact terminals which are first and second modifications of the pressing contact terminal of FIG. 15, respectively.

FIG. 16 shows a pressing contact terminal 31' employed in an electrical connection box K7' (box K7" not being shown) which is a first modification of the electrical connection box K7. In the pressing contact terminal 31', the flat plate portion 12 of the pressing contact terminal 31 is bent orthogonally into an L-shaped plate portion 22 having flat plate portions 22A and 22B. The slot 13 is formed at a lower end of the flat plate portion 22A, while the slot 14 is formed at a lower end of the flat plate portion 22B. Since the slots 13 and 14 are, respectively, formed on the flat plate portions 22A and 22B intersecting with each other orthogonally, wires intersecting with each other orthogonally can be spliced to each other by the pressing contact terminal 31'.

Figure 17:
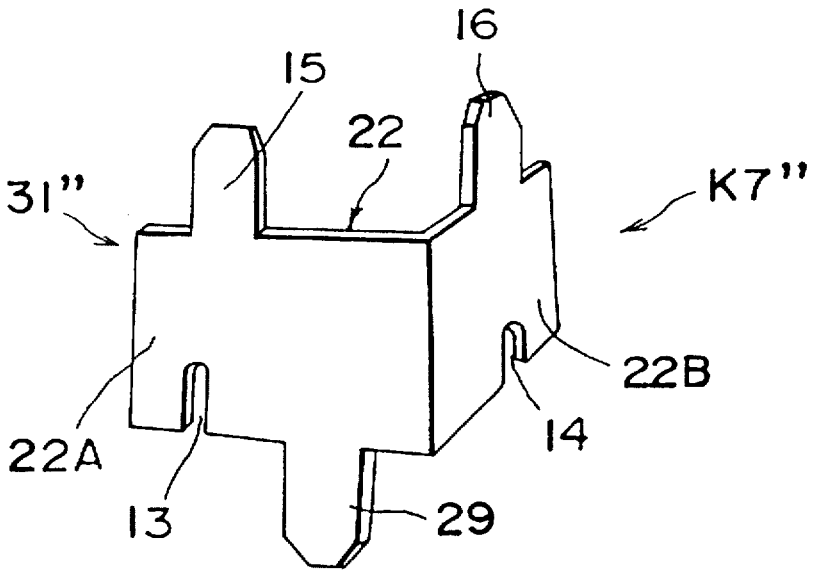

FIG. 17 shows a pressing contact terminal 31" employed in an electrical connection box K7" (box K7" not being shown) which is a second modification of the electrical connection box K7. In the pressing contact terminal 31", the slots 13 and 14 are provided at the lower end of each of the flat plate portions 22A and 22B in the same manner as the electrical connection box K7'. Meanwhile, the input-output terminal portions 15 and 16 are projected from an upper end of each of the flat plate portions 15 and 16, respectively and an input-output terminal portions 29 is further projected from the lower end of the flat plate portion 22A. Since the pressing contact terminal 31" has the upwardly extending input-output terminal portions 15 and 16 and the downwardly extending input-output terminal portion 29, the pressing contact terminal 31" can be connected, through branching, to external terminals attached to upper and lower faces of the electrical connection box K7".

Figure 18:
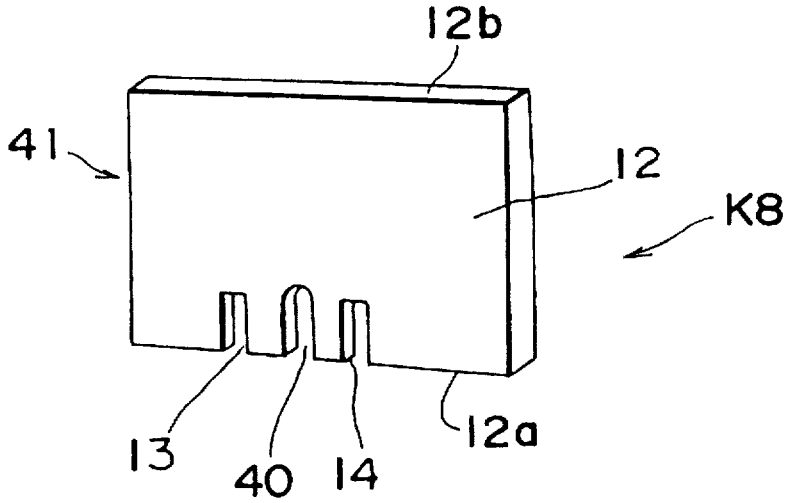
FIG. 18 is a perspective view of a pressing contact terminal employed in an electrical connection box according to an eighth embodiment of the present invention.

FIG. 18 shows a pressing contact terminal 41 employed in an electrical connection box K8 according to an eighth embodiment of the present invention. In the pressing contact terminal 41, the slots 13 and 14 are formed at the lower end 12*a* of the flat plate portion 12 so as to be spaced a predetermined interval from each other along the lower end 12*a* of the flat plate portion 12 and a large opening 40 having such a width as to loosely receiving a wire is formed at the lower end 12*a* of the flat plate portion 12 between the slots 13 and 14. When first, second and third wires are laid in parallel to each other, the slots 13 and 14 are brought into pressing contact with the first and third wires, respectively so as to splice the first and third wires to each other, while the middle second wire is loosely passed through the opening 40 without being brought into pressing contact with the pressing contact terminal 41.

As will be seen from the foregoing description of the electrical connection box of the fifth embodiment (FIG. 10), since surface area of the flat plate portion for heat dissipation is set large, heat generated at the pressing contact portions of the pressing contact terminal and heat transferred to the pressing contact terminal from external components such as a fuse and a relay connected to the pressing contact terminal can be dissipated efficiently. Therefore, such a phenomenon can be prevented that the pressing contact terminal and the wires are heated to high temperature through accumulation of heat therein. Meanwhile, since the pressing contact terminal is of a simple shape in which by blanking the electrically conductive flat plate into the rectangular shape, the slot is formed at the lower end of the flat plate portion, the pressing contact terminal can be formed easily.

Meanwhile, in the electrical connection box of the fifth embodiment, a plurality of the slots are formed at the lower end of the flat plate portion for heat dissipation. Therefore, when the slots are, respectively, brought into pressing contact with a plurality of the wires, the wires can be directly spliced to each other by the single pressing contact terminal. Meanwhile, heat is generated at a plurality of the pressing contact portions of the pressing contact terminal but surface area of the flat plate portion is large, so that heat generated at the pressing contact portions of the pressing contact terminal can be dissipated and thus, rise of temperature of the pressing contact portions of the pressing contact terminal can be restrained.

Since the tabs each having a shape of a tab are provided on the pressing contact terminal so as to be connected to the external terminals, the pressing contact terminal can be connected to the external terminals through branching and thus, the pressing contact terminal can cope with complicated configuration of the internal circuit.

In the electrical connection box of the eighth embodiment (FIG. 18), since the large opening for loosely receiving the wire is formed at the lower end of the flat plate portion, the wires which interpose therebetween the middle wire received by the opening and are thus, are laid complicatedly in the electrical connection box can be spliced to each other by the single pressing contact terminal.

Furthermore, in the electrical connection box of the first modification of the seventh embodiment (FIG. 16), since the slots are formed at the lower end of each of the flat plate portions intersecting with each other orthogonally, the wires intersecting with each other orthogonally can be spliced to each other by the pressing contact terminal and thus, are laid complicated in the electrical connection box can be spliced to each other by the single pressing contact terminal. Meanwhile, if the wire is thick and cannot be bent orthogonally easily, the wire may be severed into two wire portions and the slots of the flat plate portions intersecting with each other orthogonally are, respectively, brought into pressing contact with the wire portions As a result, laying of the two wire portions can be tantamount to laying of the single wire.

What is claimed is:

1. An electrical connection box, comprising: an internal circuit in which a plurality of pressing contact terminals contact a wire, and input-output terminals of said plurality of pressing contact terminals are connected to external circuits;

said plurality of pressing contact terminals including a first pressing contact terminal connected an external electrical heating element;

said wire including an electrically operative portion between said first pressing contact terminal and another one of said plurality of pressing contact terminals and an electrically inoperative portion; and said first pressing contact terminal having a plurality of pressing contact portions, one of said plurality of pressing contact portions being connected to a conductor of said electrically operation portion, while a conductor of the electrically inoperative portion having been routed away from and back toward said first pressing contact terminal to connect with another one of said plurality of pressing contact portions to form a loop wire portion for heat dissipation.

2. An electrical connection box as claimed in claim 1, wherein said first pressing contact terminal includes a tab connected to the external electrical heating element;

said plurality of pressing contact portions includes first and second pressing contact portions extending downwardly from said tab and intersecting with each other orthogonally;

said first and second pressing contact portions having first and second slots, respectively, such that first and second blades provided on peripheries of said first and second slots are connected to said conductors of said electrically operative portion and said electrically inoperative portion, respectively.

3. An electrical connection box, comprising:

an internal circuit in which a plurality of pressing contact terminals contact a first wire, and input-output terminals of said plurality of pressing contact terminals are connected to external circuits;

said plurality of pressing contact terminals including a first pressing contact terminal connected to an external electrical heating element;

said first wire including an electrically operative portion between said first pressing contact terminal and another one of said plurality of pressing contact terminals;

a second wire exclusively used for heat dissipation of said first wire; and said first pressing contact terminal having a plurality of pressing contact portions, one of said plurality of pressing contact portions being connected to a conductor of said electrically operative portion through pressing contact, and another one of said plurality of pressing contact portions being connected to a conductor of said second wire through pressing contact.

4. An electrical connection box as claimed in claim 3, wherein said first pressing contact terminal includes a tab connected to said external electrical heating element;

said plurality of pressing contact portions including first and second pressing contact portions extending downwardly from said tab and intersecting with each other orthogonally;

said first and second pressing contact portions having first and second slots, respectively, such that first and second blades provided on peripheries of said first and second slots connect to said conductors of said electrically operative portion and said second wire, respectively.

* * * * *